US008659481B2

(12) United States Patent
Chen et al.

(10) Patent No.: US 8,659,481 B2
(45) Date of Patent: Feb. 25, 2014

(54) INTERNAL PRINTED ANTENNA

(75) Inventors: Wen-Shan Chen, Tainan (TW); Li-Yu Yeh, Tainan (TW)

(73) Assignee: Southern Taiwan University of Technology, Tainan (TW)

( * ) Notice: Subject to any disclaimer, the term of this patent is extended or adjusted under 35 U.S.C. 154(b) by 236 days.

(21) Appl. No.: 13/278,271

(22) Filed: Oct. 21, 2011

(65) Prior Publication Data

US 2013/0099978 A1 Apr. 25, 2013

(51) Int. Cl.
*H01Q 1/38* (2006.01)

(52) U.S. Cl.
USPC ..... 343/700 MS; 343/741; 343/742; 343/743; 343/846; 343/895

(58) Field of Classification Search
USPC ..... 343/700 MS
See application file for complete search history.

(56) References Cited

U.S. PATENT DOCUMENTS

| | | | | |
|---|---|---|---|---|
| 4,364,050 | A * | 12/1982 | Lopez | 343/700 MS |
| 5,646,633 | A * | 7/1997 | Dahlberg | 343/700 MS |
| 6,867,636 | B2 * | 3/2005 | Kohsiek | 327/423 |
| 6,867,736 | B2 * | 3/2005 | Faraone et al. | 343/700 MS |

* cited by examiner

*Primary Examiner* — Jerome Jackson, Jr.
*Assistant Examiner* — Hai Tran
(74) *Attorney, Agent, or Firm* — Rosenberg, Klein & Lee

(57) ABSTRACT

An internal printed antenna is revealed. The internal printed antenna includes a dielectric substrate, a ground plane, a metal loop radiating portion, and a microstrip feed line. The metal loop radiating portion includes a plurality of bends and a gap area is formed between adjacent bends. Two short circuit parts are arranged at the gap area.

10 Claims, 12 Drawing Sheets

(a)

(b)

(c)

(d)

(e)

(f)

(g)

INTERNAL PRINTED ANTENNA

BACKGROUND OF THE INVENTION

1. Field of the Invention

The present invention relates to an internal printed antenna, especially to an internal printed antenna used for LTE700, GSM850/900, PCS, DCS, UMTS, LTE2300, and LTE2500 system operation without increasing antenna size.

2. Description of Related Art

Along with fast development of communication technology and popularity of electronic products, a plurality of communication protocols and technologies of wireless signal transmission have been developed. Wireless communication is more widely used by people and many portable electronics such as mobile phones and PDA can send and receive signals in different bands for more powerful communication capacities.

Generally, portable electronics are built-in with a dual-band or tri-band antenna so as to send and receive signals in different bands. However, such antenna operates only in two or three separate bands, without ranging bands commonly used. Refer to U.S. Pat. No. 6,727,854, a planar inverted-F antenna is revealed. The operating frequency band of the antenna is within bands of the GSM900 system and the DCS system.

Moreover, refer to Taiwanese Patent Pub. App. No. 1254493, a dual-band inverted-F antenna is disclosed. By two radiating elements having a T-shaped radiating metal part and an adjustment metal sheet, bandwidth, impedance matching and gain of the antenna are adjusted to achieve dual-frequency or multiple frequency operation. However, the frequency of bands available now is lower. Such design not only increases the antenna size that occupies space and doesn't meet requirements of light weight and compact design. Moreover, the resonance of the resonant multi-pathway resonance makes the antenna structure become more complicated. The manufacturing processes are complex and the cost is increased.

SUMMARY OF THE INVENTION

Therefore it is a primary object of the present invention to provide an internal printed antenna whose frequency band ranges most of commonly used wireless communication systems including LTE700, GSM850/900, PCS, DCS, UMTS, LTE2300, LTE2500, etc without increasing antenna size so as to overcome above shortcomings.

In order to achieve the above object, an internal printed antenna of the present invention includes a dielectric substrate, a ground plane, a metal loop radiating portion, and a microstrip feed line. The dielectric substrate consists of a first surface and a second surface opposite to the first surface and with the ground plane being disposed on the first surface for signal ground. Then the metal loop radiating portion is formed on the first surface by printing or etching and is connected to an edge at one side of the ground surface. The metal loop radiating portion is composed of a plurality of bends and a gap area is formed between adjacent bends. The gap area is provided with two short circuit parts. Then the microstrip feed line corresponding to the metal loop radiating portion is disposed on the second surface. One end of the microstrip feed line is a signal feeding end of the antenna while the other end thereof is a coupling end. The coupling end consists of a rectangular main body and two extending parts connected to the rectangular main body. The rectangular main body includes a vertical first slot having an opening at one end, a horizontal slot connected to the first slot, and a vertical second slot having one end connected to the horizontal slot. Moreover, the extending parts are respectively located at the left side and right side of the rectangular main body 5. The extending parts include a rectangular first extending part connected to the right side of the rectangular main body and an L-shaped second extending part connected to the left side of the rectangular main body. The first extending part and the second extending part are extending from the right side and the left side of the rectangular main body symmetrically.

Thereby the resonance of the resonant double pathway is generated by the two short circuit parts at the gap area. This results in resonance at different frequencies to reach a wide-band. Next impedance matching of the antenna is adjusted by the microstrip feed line without increasing the antenna volume and is used for LTE700, GSM850/900, PCS, DCS, UMTS, LTE2300, and LTE2500 system operation.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
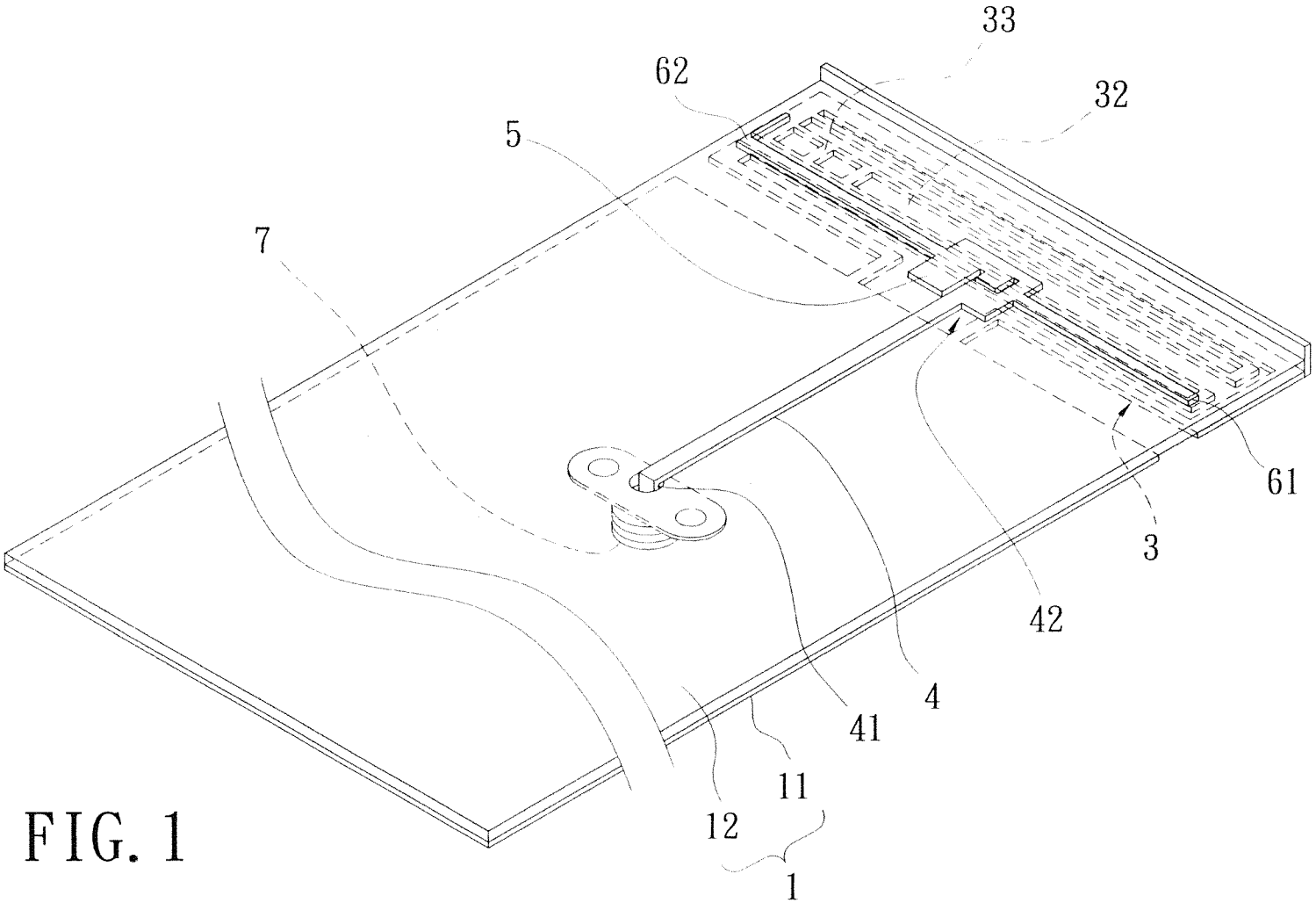
FIG. 1 is a perspective view of an embodiment according to the present invention.
Figure 2:
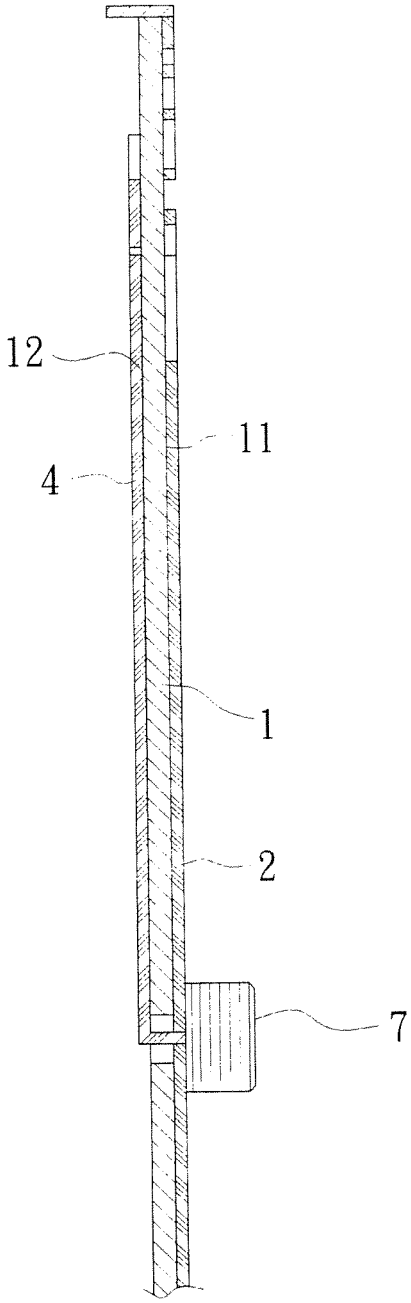
FIG. 2 is a side view of an embodiment according to the present invention.
Figure 3:
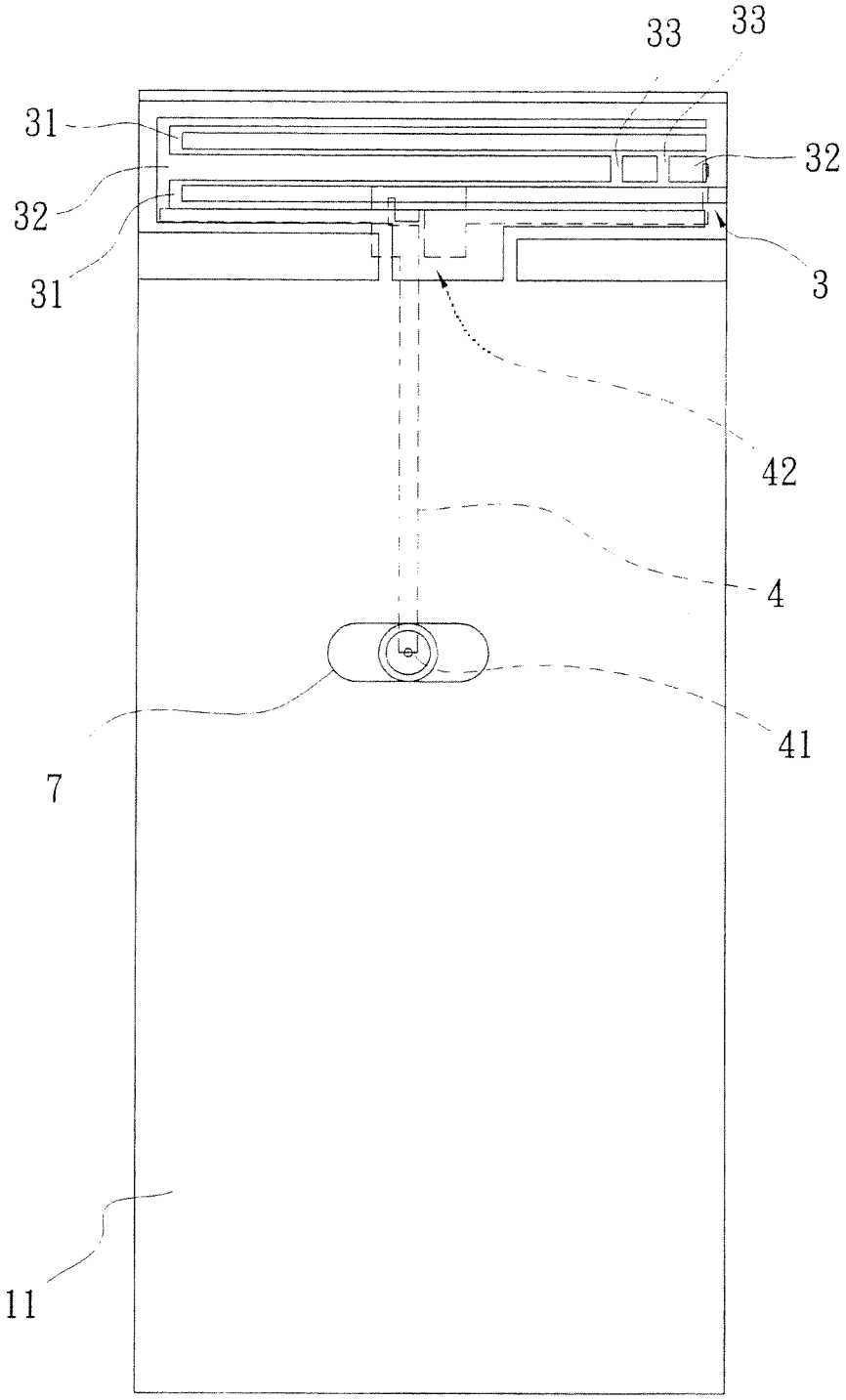
FIG. 3 is a schematic drawing showing a first surface of a dielectric substrate of an embodiment according to the present invention.

Refer from FIG. 1 to FIG. 4, an internal printed antenna of the present invention mainly includes a dielectric substrate 1, a ground plane 2, a metal loop radiating portion 3, and a microstrip feed line 4.

The dielectric substrate 1 includes a first surface 11 and a second surface 12 corresponding to the first surface 11. In this embodiment, the dielectric substrate 1 is made from FR4 epoxy fiberglass.

The ground plane 2 is positioned on the first surface 11 for signal ground.

The metal loop radiating portion 3 is located at the first surface 11 and is connected to an edge at one side of the ground plane 2. The metal loop radiating portion 3 includes a plurality of bends 31 while a gap area 32 formed between adjacent bends 31. The gap area 32 is disposed with at least one short circuit part 33. In this embodiment, there are two short circuit parts 33.

Figure 4:
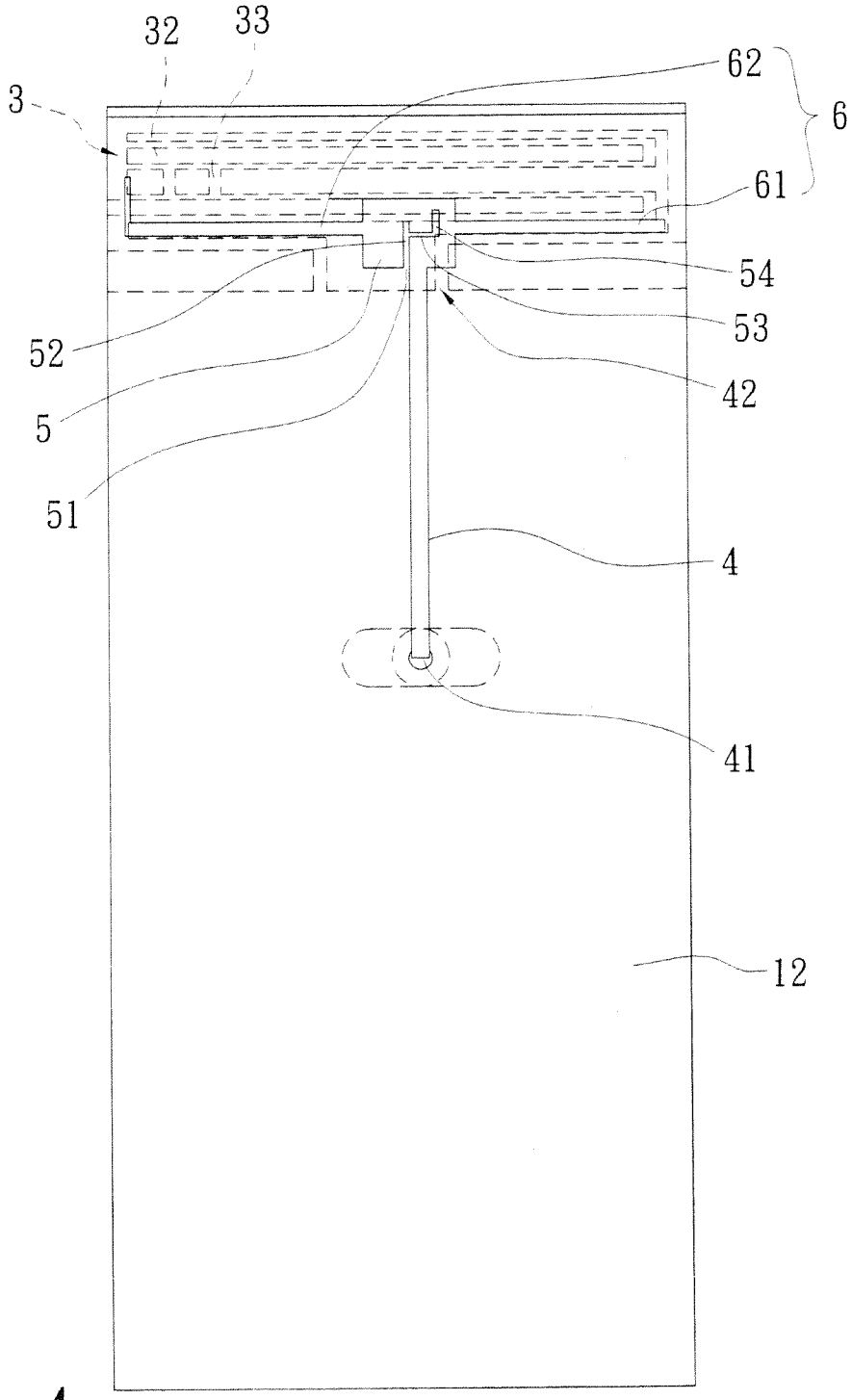
FIG. 4 is a schematic drawing showing a second surface of a dielectric substrate of an embodiment according to the present invention.

The microstrip feed line 4 is connected to the metal loop radiating portion 3 and is disposed on the second surface 12. Refer to FIG. 4, one end of the microstrip feed line 4 is a signal feeding end 41 of the antenna while the other end thereof is a coupling end 42. The coupling end 42 consists of a rectangular main body 5 and two extending parts 6 connected to the rectangular main body 5. The rectangular main body 5 includes a vertical first slot 52 having an opening 51 at one end, a horizontal slot 53 connected to the first slot 52, and a vertical second slot 54 having one end connected to the horizontal slot 53. Moreover, the extending parts 6 are respectively connected to the left side and right side of the rectangular main body 5. The extending parts 6 include a rectangular first extending part 61 connected to the right side of the rectangular main body 5 and a L-shaped second extending part 62 connected to the left side of the rectangular main body 5. The first extending part 61 and the extending part 62 are extending from the right side and the left side of the rectangular main body 5 symmetrically.

Furthermore, the thickness, the length and the width of the dielectric substrate 1 in this embodiment are respectively 0.8 mm, 110 mm, and 50 mm. The metal loop radiating portion 3 is formed on the first surface 11 by printing or etching and is able to generate full wavelength at 820 MHz. The impedance of the microstrip feed line is 50 ohm. The dielectric substrate 1 is further disposed with a connector 7 that passes through the ground plane 2 and the dielectric substrate 1. The connector 7 is connected to the signal feeding end 41 of the microstrip feed line for feeding signals. The connector 7 can be a 50 ohm SMA (SubMiniature version A) connector.

Figure 5:
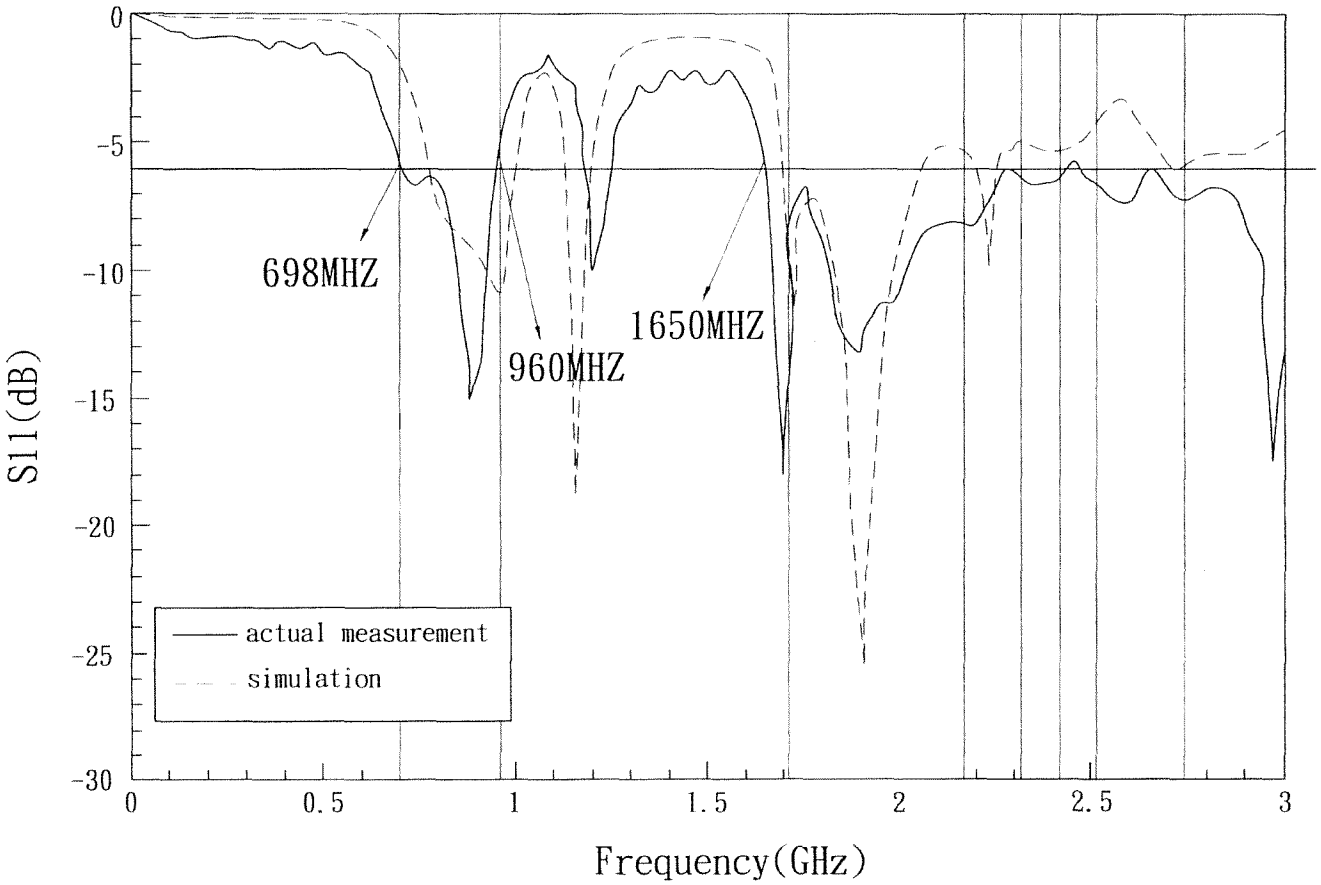
FIG. 5 shows return loss/frequency response of an embodiment according to the present invention.

Refer to FIG. 5, return loss frequency response of an embodiment of the present invention is revealed. The results of actual measurement and simulation of Ansoft HFSS (high frequency structure simulator) are shown in the figure. When the return loss is defined about −6 dB, the bandwidth at lower band ranges from 690 MHz to 970 MHz, which covers 698~787 MHz and 824~960 MHz for LTE 700 system and GSM 850/900 system operation. And the bandwidth at the upper band covers 1700 MHz to 3000 MHz for DCS/PCS/UMTS/LTE2300/LTE2500 operation. The operating frequency of DCS/PCS/UMTS/LTE2300/LTE2500 systems is 1710~1880 MHz, 1880~1990 MHz, 1920~2170 MHz, 2305~2400 MHz, and 2500~2690 MHz respectively.

Figure 6:
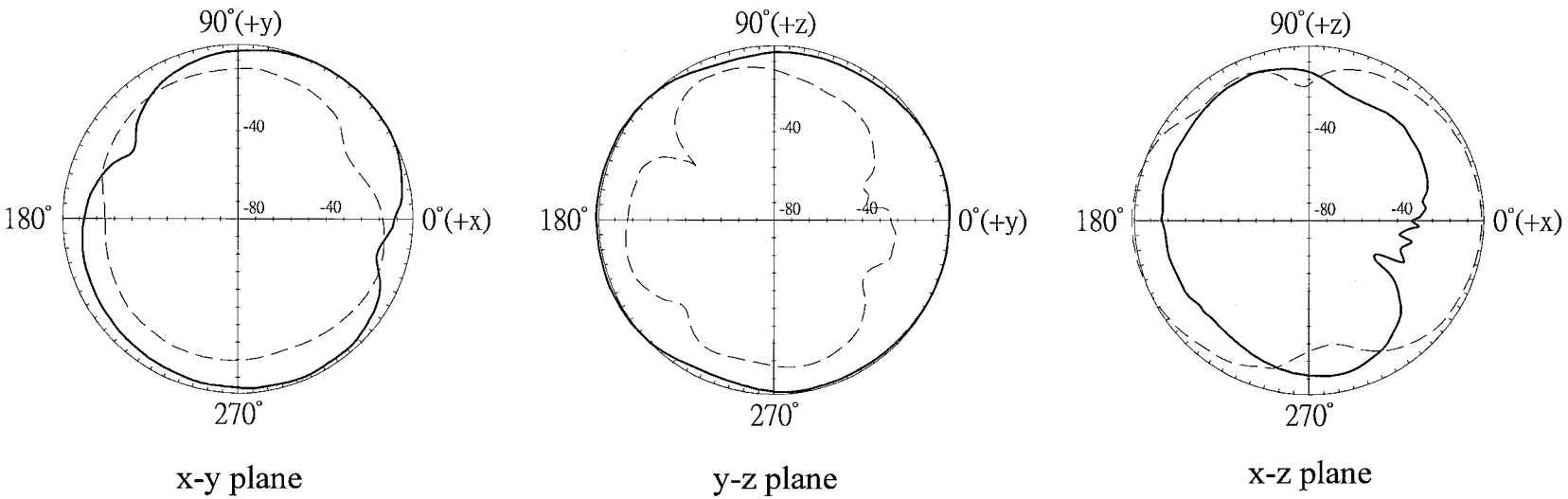
FIG. 6 shows radiation patterns at 740 MHz of an embodiment according to the present invention.
Figure 7:
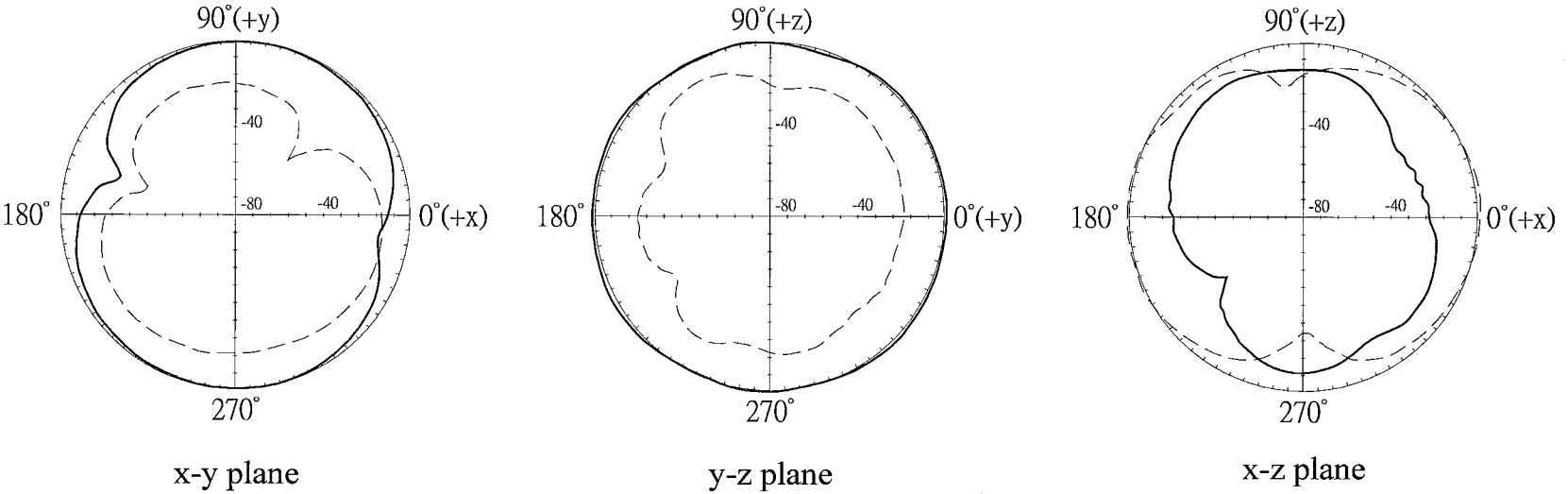
FIG. 7 shows radiation patterns at 860 MHz of an embodiment according to the present invention.
Figure 8:
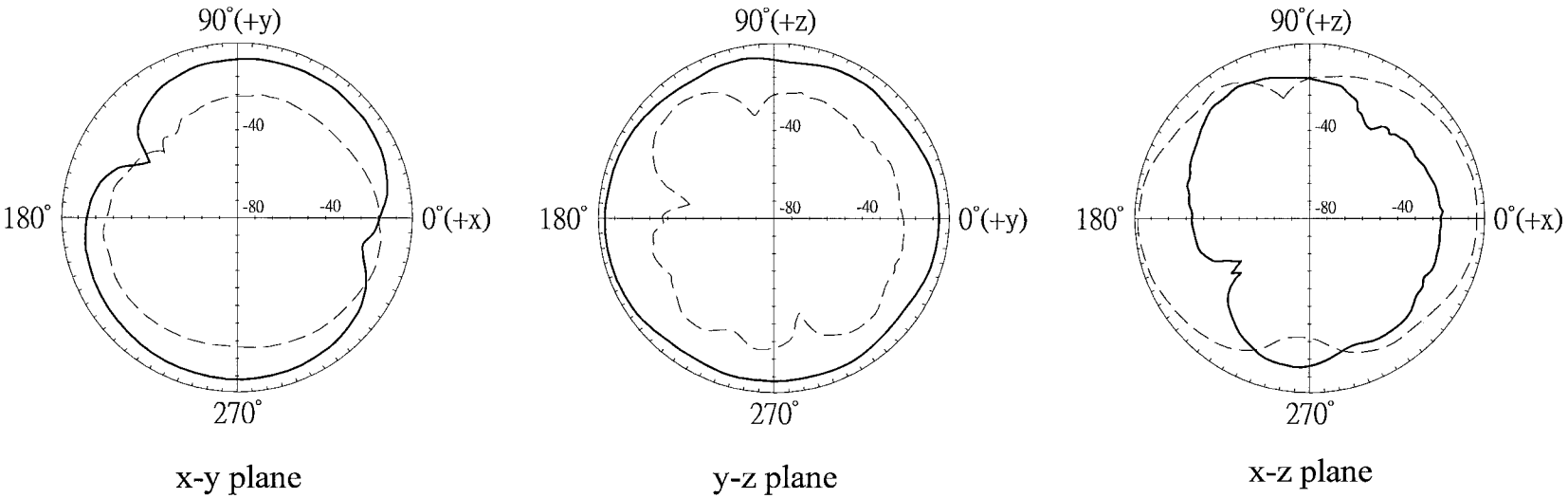
FIG. 8 shows radiation patterns at 920 MHz of an embodiment according to the present invention.
Figure 9:
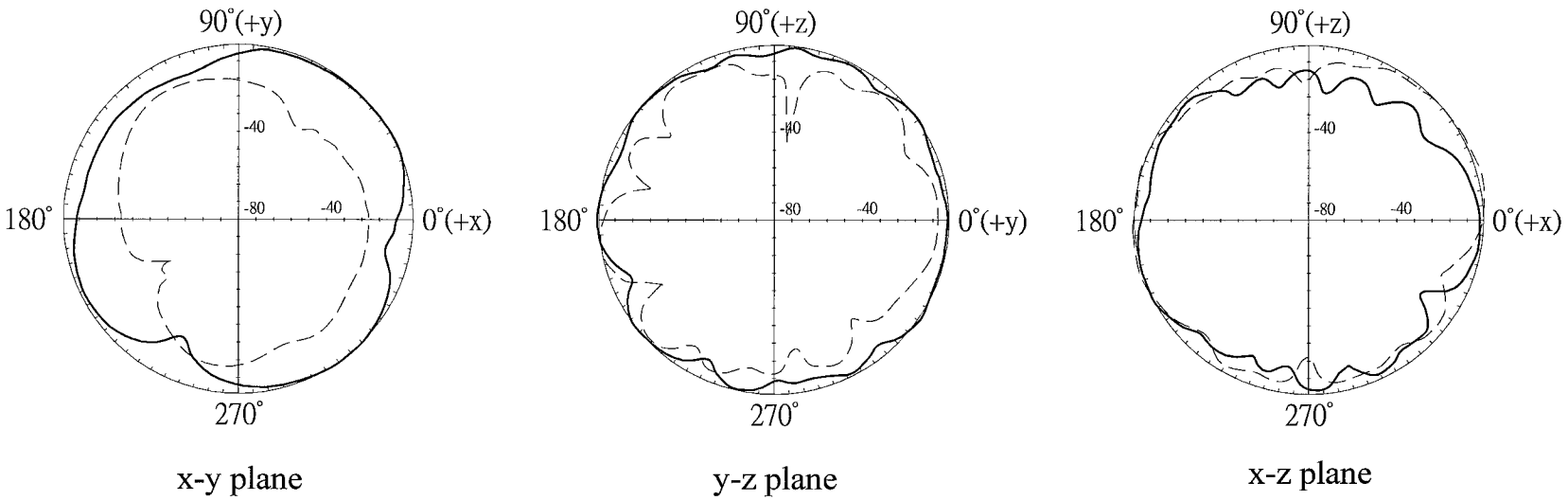
FIG. 9 shows radiation patterns at 1785 MHz of an embodiment according to the present invention.
Figure 10:
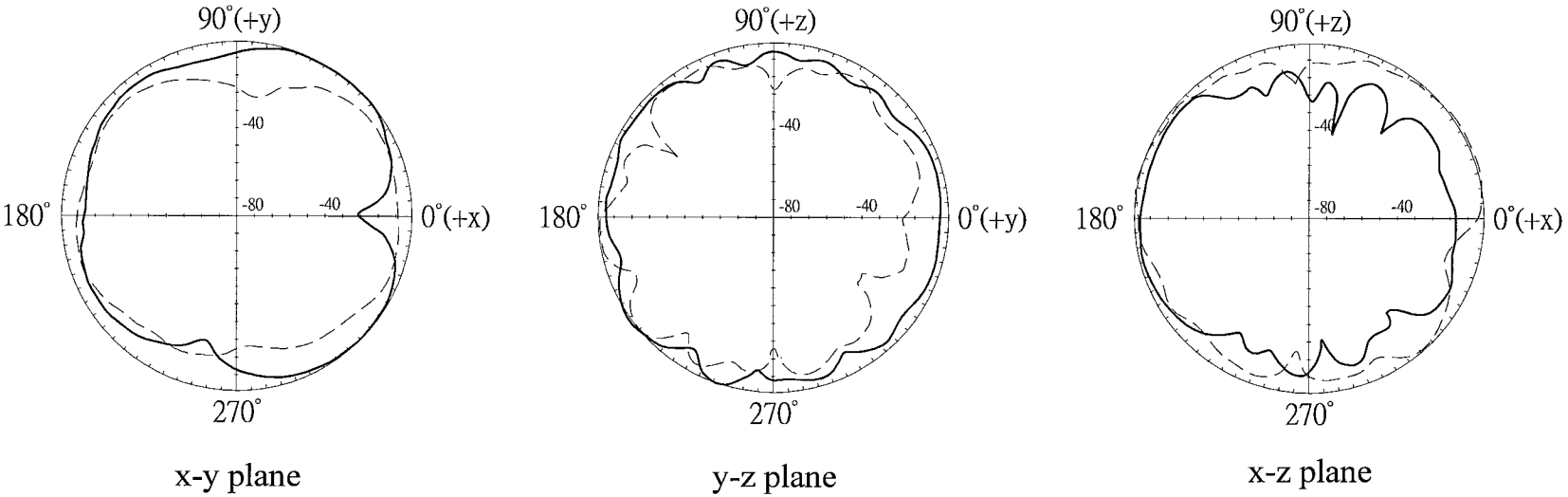
FIG. 10 shows radiation patterns at 1920 MHz of an embodiment according to the present invention.
Figure 11:
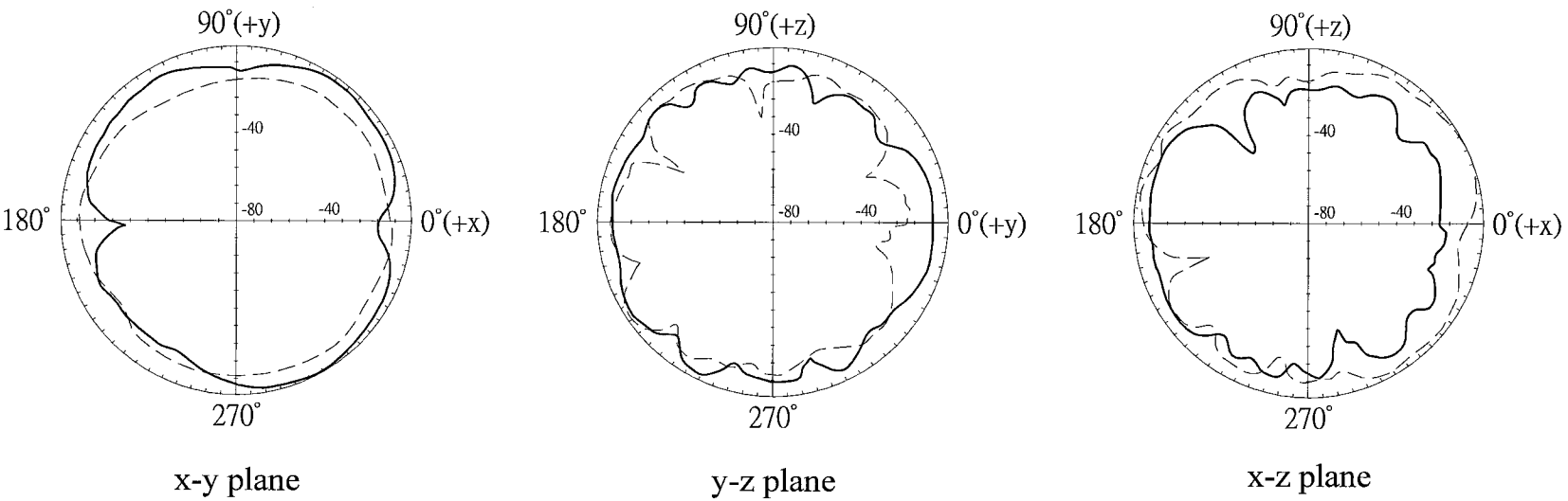
FIG. 11 shows radiation patterns at 2040 MHz of an embodiment according to the present invention.
Figure 12:
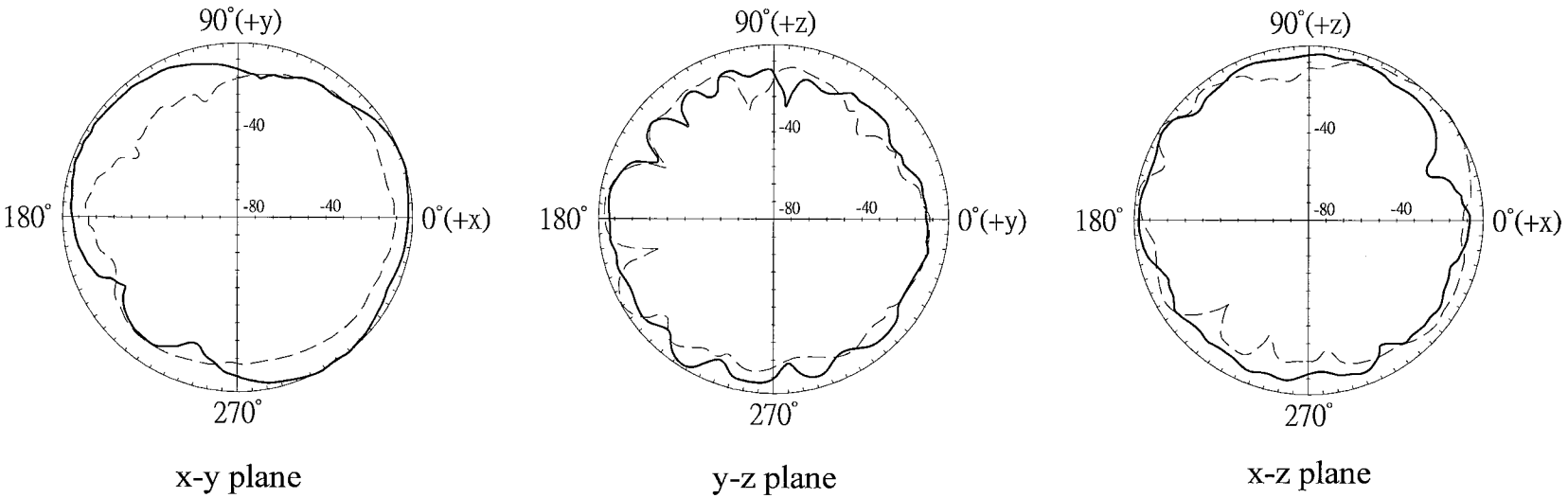
FIG. 12 shows radiation patterns at 2350 MHz of an embodiment according to the present invention.

Refer from FIG. 6 to FIG. 8, radiation patterns at 740 MHz, 860 MHz, and 920 MHz of an embodiment according to the present invention are revealed. It is learned from the figures that the x-y plane features on that the radiation pattern is omni-directional, the y-z plane and the x-z plane also have better radiation characteristics. Refer from FIG. 9 to FIG. 12, radiation patterns at 1785 MHz, 1920 MHz, 2040 MHz, and 2350 MHz of an embodiment of the present invention are disclosed. The results show that radiation pattern in the x-y plane achieves good radiation performance and the radiation patterns in other planes have similar characteristics. Thus the antenna provides better characteristics and more stable transmission in communication systems.

In summary, firstly use the metal loop radiating portion to produce full wavelength at 820 MHz. Then generate multiple resonances through double pathways by the two short circuit parts 33 of the gap area 32. The resonance at different frequencies causes a wide-band. Moreover, the impedance matching of the whole antenna is adjusted by the microstrip feed line 4 without increasing the volume of the whole antenna. Thus the start frequency and stop frequency of the low frequency band are 690 MHz and 970 MHz while the start frequency and stop frequency of the high frequency band are 1700 MHz and 3000 MHz.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An internal printed antenna comprising:

an dielectric substrate having a first surface and a second surface corresponding to the first surface;

a ground plane arranged at the first surface for signal ground;

a metal loop radiating portion that is on the first surface and is connected to an edge at one side of the ground surface; the metal loop radiating portion having a plurality of bends and a gap area is formed between adjacent bends; the gap area is disposed with at least one short circuit parts; and a microstrip feed line that is corresponding to the metal loop radiating portion and is disposed on the second surface; one end of the microstrip feed line is a signal feeding end of the antenna while the other end thereof is a coupling end having a rectangular main body and two extending parts connected to the rectangular main body; the rectangular main body includes a vertical first slot having an opening at one end, a horizontal slot connected to the first slot, and a vertical second slot having one end connected to the horizontal slot; the two extending parts are respectively connected to left and right sides of the rectangular main body while the extending part connected to the right side of the rectangular main body is a rectangular first extending part and the extending part connected to the left side of the rectangular main body is a L-shaped second extending part.

2. The device as claimed in claim 1, wherein the metal loop radiating portion is used to generate full wavelength at 820 MHz.

3. The device as claimed in claim 1, wherein the internal printed antenna further includes a connector that passes through the ground plane and the dielectric substrate; the connector is connected to the signal feeding end of the microstrip feed line for feeding signals.

4. The device as claimed in claim 3, wherein the connector is a 50 ohm SMA (SubMiniature version A) connector.

5. The device as claimed in claim 1, wherein impedance of the microstrip feed line is 50 ohm.

6. The device as claimed in claim 1, wherein the dielectric substrate is made from FR4 epoxy fiberglass.

7. The device as claimed in claim 1, wherein the metal loop radiating portion is formed on the first surface by printing or etching.

8. The device as claimed in claim 1, wherein the first extending part and the second extending part are extending from the right side and the left side of the rectangular main body symmetrically.

9. The device as claimed in claim 1, wherein thickness of the dielectric substrate is 0.8 mm.

10. The device as claimed in claim 1, wherein length and width of the dielectric substrate are respectively 110 mm and 50 mm.

* * * * *